United States Patent [19]

Kramer et al.

[11] Patent Number: 4,677,892

[45] Date of Patent: Jul. 7, 1987

[54] ELECTRICAL ACTUATOR FOR PERCUSSION INSTRUMENTS

[76] Inventors: Justin Kramer, 1028 W. 8th Pl., Los Angeles, Calif. 90017; Richard H. Peterson, 11601 S. Mayfield Ave., Worth, Ill. 60482

[21] Appl. No.: 782,324

[22] Filed: Oct. 1, 1985

[51] Int. Cl.[4] ..... G10D 13/08

[52] U.S. Cl. ..... 84/405; 116/167; 116/155

[58] Field of Search ..... 84/102, 103, 104, 404, 84/405, 406, 407; 116/167, 169, 155, 164

[56] References Cited

U.S. PATENT DOCUMENTS 1,781,927 11/1930 Klein ..... 84/405 X 3,361,902 1/1968 Cardenas et al. ..... 84/407 X

FOREIGN PATENT DOCUMENTS 3106 of 1886 United Kingdom ..... 84/407

*Primary Examiner*—L. T. Hix

*Assistant Examiner*—Brian W. Brown

*Attorney, Agent, or Firm*—Jones, Tullar & Cooper

[57] ABSTRACT

An improved striker mechanism for percussion instruments such as chimes, bells, drums, and the like, is disclosed. A clapper is mounted on an armature for motion between a rest position and an impact position. A solenoid-permanent magnet set is provided to hold the clapper in its rest position. Energization of the solenoid by a short electrical drive pulse produces a magnetic field in the solenoid core which repels the permanent magnet and drives the clapper to impact a percussion instrument sound-producing surface. The drive pulse is sufficiently short that it does not impede rebound of the clapper, so that the rebound force cooperates with the magnetic attraction of the permanent magnet to the solenoid to return the clapper to its rest position, substantially without bounce, thereby producing a highly damped clapper motion.

17 Claims, 4 Drawing Figures

ELECTRICAL ACTUATOR FOR PERCUSSION INSTRUMENTS

BACKGROUND OF THE INVENTION

The invention relates to percussive musical instruments. Such instruments include but are not limited to bells, chimes, gongs, glockenspiels, xylophones, harps, drums, and the like. The invention is especially concerned with the playing of these instruments by electrically actuated means. In all of these instruments, sound is produced as the result of the action between a striker, or clapper, and a struck object. In a bell, for example, the object struck is a bell and the striker is a clapper; in a xylophone, the object struck is a tuned wooden bar, and the striker is a mallet; in a drum, the object struck is a drum, and the striker is a drum stick. The one thing common to all is that, in order to produce a sound, it is necessary to accelerate a mass sufficiently that when this mass strikes the struck object, the desired sound will be produced. The loudness of the sound will depend, among other things, on the speed of travel of the armature.

It should be noted that in all cases, the object struck, which may be referred to as the instrument, has the qualities of hardness and elasticity. Therefore, when the clapper strikes the instrument, the interaction which takes place will cause the clapper to be accelerated in the opposite direction. This acceleration in the direction opposite to strike is sometimes referred to as the rebound. In prior electrically actuated percussive instruments, control of the rebound has proved to be very troublesome.

Perhaps the most common and well-known type of electrically controlled striker has been that used in door chimes where the clapper consists of a moveable iron core which forms the armature core of an electrical solenoid. The armature core is held by a spring in a rest position that is off center of the solenoid. When the solenoid coil is energized, the armature core will be drawn toward the center of the solenoid; however, because of the fact that such a core is a mass which is accelerated by such an action, the stored energy will cause it to overtravel the center and strike the chime tube. Having struck the chime tube, the armature will rebound and then oscillate due to the spring and to the fact that such a system provides poor means for damping such vibration. Another drawback of such a system is the fact that, since the armature moves within the solenoid, it moves in an environment where parts rub against each other. Such friction produces undesirable noise and reduces efficiency. Another element of such a system which reduces efficiency is the fact that energy is required to overcome the force applied to the armature by the action of the spring. While other devices, such as pneumatic systems, have been employed to actuate strikers, they have all suffered from similar problems.

Another drawback of prior electrically operated systems has been the fact that sometimes the force of the solenoid holds the striker against the object struck so that it does not immediately rebound, thereby producing a very poor or damped sound.

Besides the problems of inefficiency and noise have been the drawbacks from the standpoint of the musician. Prior solenoid type devices have been subject to corrosion, accumulation of dirt, or the like, which can change the frictional characteristics of the solenoid and produce erratic, unpredictable action, both as to the timing of the armature motion after energization of the solenoid and the force of the striking motion. Thus, there is poor sound regulation with such devices, especially when soft sounds are desired. Some devices don't work at all without regular cleaning and adjustment. Further, because of the lack of damping of the oscillation or vibration on the rebound, as well as the friction inherent in the systems, it has, until the present invention, been impossible for the performer to repeat notes rapidly and each time secure the desired loudness. From the standpoint of the musician, this has been very undesirable.

SUMMARY OF THE INVENTION

It is therefore, among the objects of the invention to provide a new and improved electrically actuated striker, or clapper, for percussive musical instruments in which the striker will not produce unwanted noise in the course of its movement.

Another object of the invention is to provide an electrically actuated clapper in which the rebound of the clapper will be so controlled that after it has impacted on the object struck, it will immediately rebound and quickly return to the rest position.

Yet another object of the invention is to provide an electrically actuated striker in which the force by which the striker impacts the object struck can be reliably controlled by the musician playing the instrument so that, at all times, the desired loudness or softness of the struck sound is at the will of the performer.

Briefly, the invention is directed to an actuator mechanism for percussion instruments wherein an armature carrying a clapper and a permanent magnet is suspended on a flexible strap for motion along a predetermined path. A solenoid with a fixed iron core is mounted at one end of the path of the clapper so that at rest the permanent magnet holds the clapper at a rest position. Electrical current applied to the solenoid coil creates a magnetic field in the iron core which has a polarity to repel the permanent magnet, causing the clapper to swing away from the solenoid and to strike a sound-producing surface such as a bell, chime, drum, or other percussive musical instrument. Preferably, the electrical current is in the form of a relatively short pulse which ends before or at the time the clapper strikes the sounding surface, so that the magnetic field of the iron core collapses or has collapsed upon rebound. The clapper is then free to travel back toward the iron core, which captures the permanent magnet and pulls the clapper to its rest position, thereby effectively damping the motion and preventing vibration. The magnitude of the electrical current pulse regulates the power of the strike, and thus the volume of the sound produced, while the damping action of the permanent magnetic and iron core allows rapid repetition of the strike without deterioration of the sound or interference from the resonance of the mechanism. The use of a strap to mount the clapper substantially eliminates the effects of friction, corrosion, and accumulation of dust and dirt, thereby improving the efficiency and controllability of the instrument and reducing the need for adjustment and maintenance.

BRIEF DESCRIPTION OF THE DRAWINGS

The foregoing and additional objects, features, and advantages of the present invention will be apparent to those of skill in the art from the following detailed description of preferred embodiments thereof, taken with the accompanying drawings, in which.

DESCRIPTION OF PREFERRED EMBODIMENTS

Figure 1:
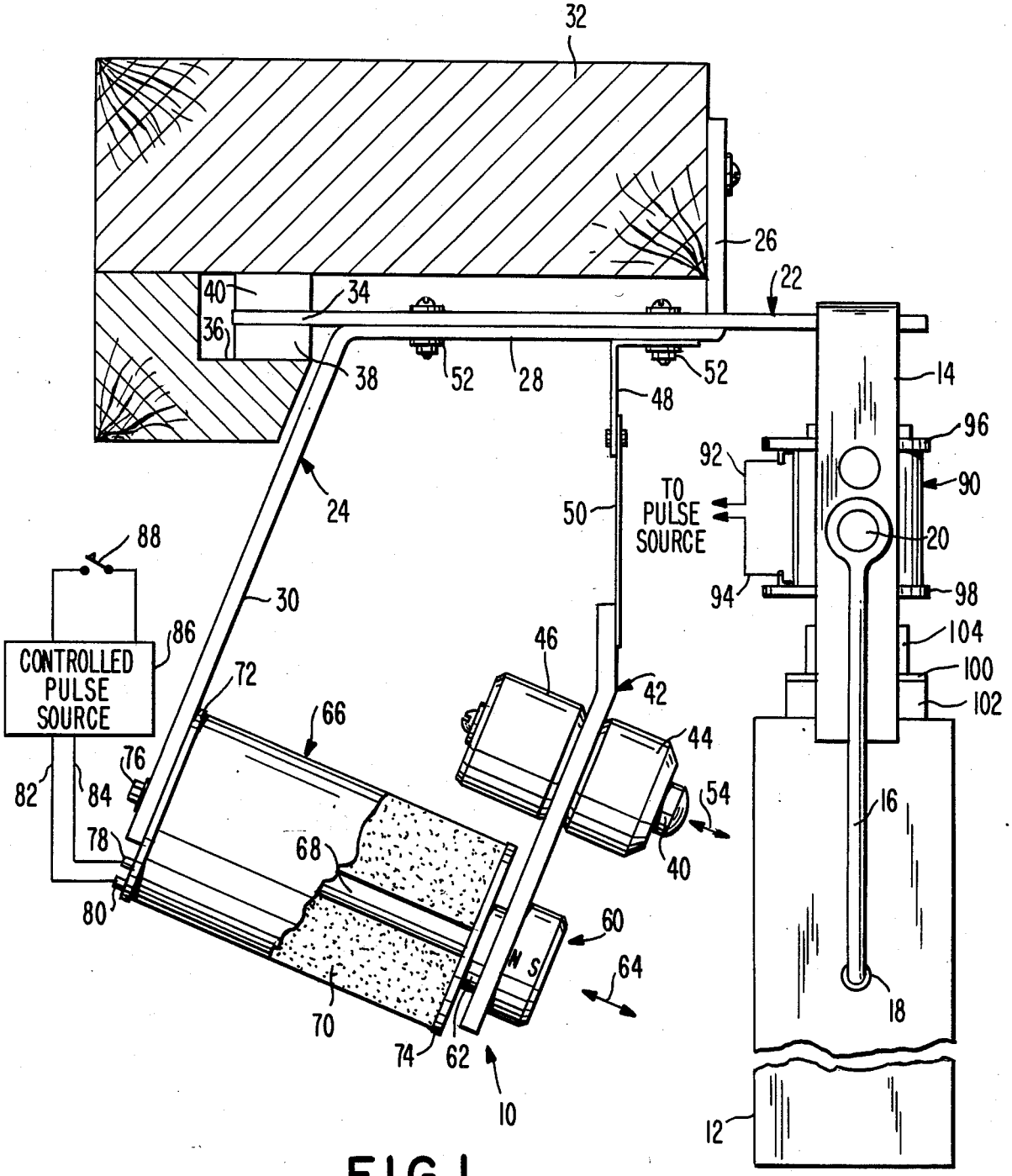
FIG. 1 is a diagrammatic side elevational view of percussion instrument striker constructed in accordance with the present invention and shown in combination with a vertically hanging chime.

Turning now to FIG. 1 of the drawings, there is illustrated at 10 a striker mechanism constructed in accordance with the present invention for use with a wide variety of surfaces which are capable of producing a sound when struck. In particular, the striker 10 is used with the sound-producing surfaces of percussive musical instruments such as bells, chimes, cymbals, drums, marimbas, xylophones, glockenspiels, door chimes, and the like, and provides means for electrically controlling the playing of such instruments. In FIG. 1, the striker 10 is shown in combination with a tubular sounding surface 12 such as a chime. Ordinarily, several chimes of different lengths, from about 3 to 5 feet, will be provided, with each chime being provided with an individual, corresponding, electrically operated striker. The chime tube 12 may be suspended from a rigid, U-shaped strap 14 by means of a flexible cord 16 which passes through holes 18 on diametrically opposed sides of the chime. The cord 16 is fastened at one end to stud 20 on one leg of the U-shaped strap 14 and passes through the holes 18, with the opposite end of the cord (not shown) being attached to a similar stud on the other leg of strap 14.

The closed end of the U-shaped strap 14 passes over the top of a horizontal support bar 22 and is securely fastened thereto so that the legs of strap 14 depend vertically on each side of bar 22. The bar 22 is firmly secured to a support bracket 24 which includes an upstanding flange 26, a horizontal intermediate portion 28 to which bar 22 is fastened, and an angled support arm 30. The flange 26 is fastened to a framework 32 which may be a part of a wood fame for the chimes, and which provides a stable support for the entire mechanism. The flange 26 extends upwardly through the bar 22, with the intermediate portion 28 of the bracket 24 being fastened along its length to the undersurface of the bar. The end 34 of bar 22 extends beyond the bracket and into a slot 36 formed in framework 32. The end 34 of the bar is secured in the slot by means of vibration dampening felt pads 38 and 40 which serve to stabilize the bracket 24.

The striker 10 is mounted on bracket 24, and includes a hammer, or clapper, 40, which preferably is a dome-shaped piece of material suitable for striking a chime to produce the desired sound. Many materials, both plastic and metal, are suitable for clappers, the selection depending upon the timbre of the sound desired. Clapper 40 is securely fastened to the mid portion of a moveable armature 42 by way of ballast elements 44 and 46 secured to opposite sides of the armature. The armature 42 is an elongated, flat metal plate which is suspended from bracket 24 by way of hinge bracket 48 and a hinge member 50. The hinge member 50, which is a piece of flat, flexible material of metal or other material, is fastened at its lower end to the top of armature 42, and at its upper end to the end of one leg of the L-shaped bracket 48. The other leg of bracket 48 is secured to the underside of bracket 28, as by one of the fasteners 52 securing bracket 24 to bar 22. The flexible hinge member 50 allows the clapper 40 and its ballast to swing back and forth along an arcuate strike path, indicated by arrow 54. The clapper is mounted adjacent to the chime tube 12, with the chime tube lying in the path of the clapper when it swings on hinge member 50, so that motion of the clapper from the rest position illustrated in FIG. 1 along its strike path will cause the clapper to impact on the chime tube 12 to produce sound.

The lower portion of armature 42 carries a permanent magnet 60 which is fixedly mounted in an aperture in the armature. A felt pad 62 is mounted on the end of the magnet which extends into the armature, with the pad extending beyond the armature. The permanent magnet moves along an arcuate path, indicated by arrow 64, which is concentric to that of the clapper. Located in the path of the permanent magnet is an electrical solenoid 66 which consists of an iron core 68 surrounded by an electrical coil 70 and end pieces 72 and 74. The solenoid is mounted on the support arm 30 of bracket 24, as by way of bolt 76, with the coil 70 being electrically connected by way of terminals 78 and 80 and lines 82 and 84 to a suitable source 86 of electrical power. The power source may be controlled by a push button or key 88 to produce an electrical pulse on lines 82, 84 to energize the coil 70 with a current of selectable amplitude and/or duration.

When no current is supplied to the solenoid 66, which is referred to as the rest condition and is illustrated in FIG. 1, the permanent magnet is attracted to the iron core 68 to clamp the armature 42 against the end piece. The felt 62 prevents the armature and permanent magnet from striking the iron core 68 or the end piece 74 to insure quiet operation of the striker mechanism 10.

When a pulse of current is applied to the solenoid coil 70, as by closure of key 88, the solenoid is energized. The polarity of the current is selected to produce in core 68 a magnetic polarity which is the same as that of the pole of permanent magnet 60 which is nearest the end piece 74; thus, for example, if the permanent magnet has a polarity as indicated in FIG. 1, then a current would be applied to coil 70 in a direction to produce north pole at end piece 74. This will cause the permanent magnet 60 to be repelled from its rest position and will cause it to swing along path 64, toward chime 12 to cause the clapper 40 to strike the chime and produce the desired sound. When the pulse of current ends, the magnetic field induced in core 68 collapses, so that the magnet 60 will again be drawn toward core 68. The rebound of the clapper from the chime initiates its return toward the rest position, and by terminating the current supplied to the coil just as, or just before, the clapper impacts on the chime, the clapper return to the rest position is facilitated. This results in a highly damped mechanism, where the clapper strikes the chime and returns directly to its rest position, without vibration or delay, so that the clapper is ready for the next stroke.

It should be noted at this point that each time chime tube 12 is struck by clapper 40, it will continue to vibrate for a very long time, producing a chime sound. However, this is not always desirable. In order to limit the time of the vibration, a second electrical solenoid 90, having electrical leads 92 and 94, and end pieces 96 and 98, is securely fastened to strap 14. Moveably mounted inside solenoid 90 is an armature (not shown) which carries a faceplate 100 which, in turn, is attached to felt pad 102. When no current passes through solenoid 90, the force of gravity will cause its armature and the attached face plate 100 and felt pad 102 to rest on top of chime tube 12. In the event that clapper 40 were to strike chime tube 12 under this condition, the sound would be muffled because felt pad 102 would damp the vibrations of chime tube 12. On the other hand, if an electrical current is applied to solenoid 90, its armature will be drawn upward into the solenoid, thereby lifting faceplate 100 and felt pad 102. This action will allow chime tube 12 to vibrate freely, which condition will exist until the current applied to solenoid 90 is interrupted, at which time the armature will fall and felt pad 102 will again come in contact with chime tube 12 to damp its vibration. Therefore, the sounding period of chime tube 12 may be controlled as follows: electrical current is simultaneously applied to solenoids 66 and and 90. This causes felt pad 102 to rise, leaving chime tube 12 free to vibrate, and will cause clapper 40 to strike chime tube 12. As soon as clapper 40 strikes chime tube 12, the electrical current applied to solenoid 66 is interrupted, but the electrical current applied to solenoid 90 is continued for the time desired for chime tube 12 to vibrate; it is interrupted at the end of this time to then dampen the vibration of chime tube 12.

To insure quiet operation of solenoid 90, a felt washer 104 may be provided between faceplate 100 and end piece 98 to prevent the faceplate from striking the end piece.

Although the striker 10 is shown in combination with a chime, it is apparent that it may be used with other sounding surfaces. If the hinge 50 is very flexible, to obtain minimum resistance to the motion of the striker, then the mechanism as shown will preferably be used in the vertical orientation illustrated. Use of a relatively stiff hinge piece 50 would allow the device to be used in other orientations, but with less efficiency.

Figure 2:
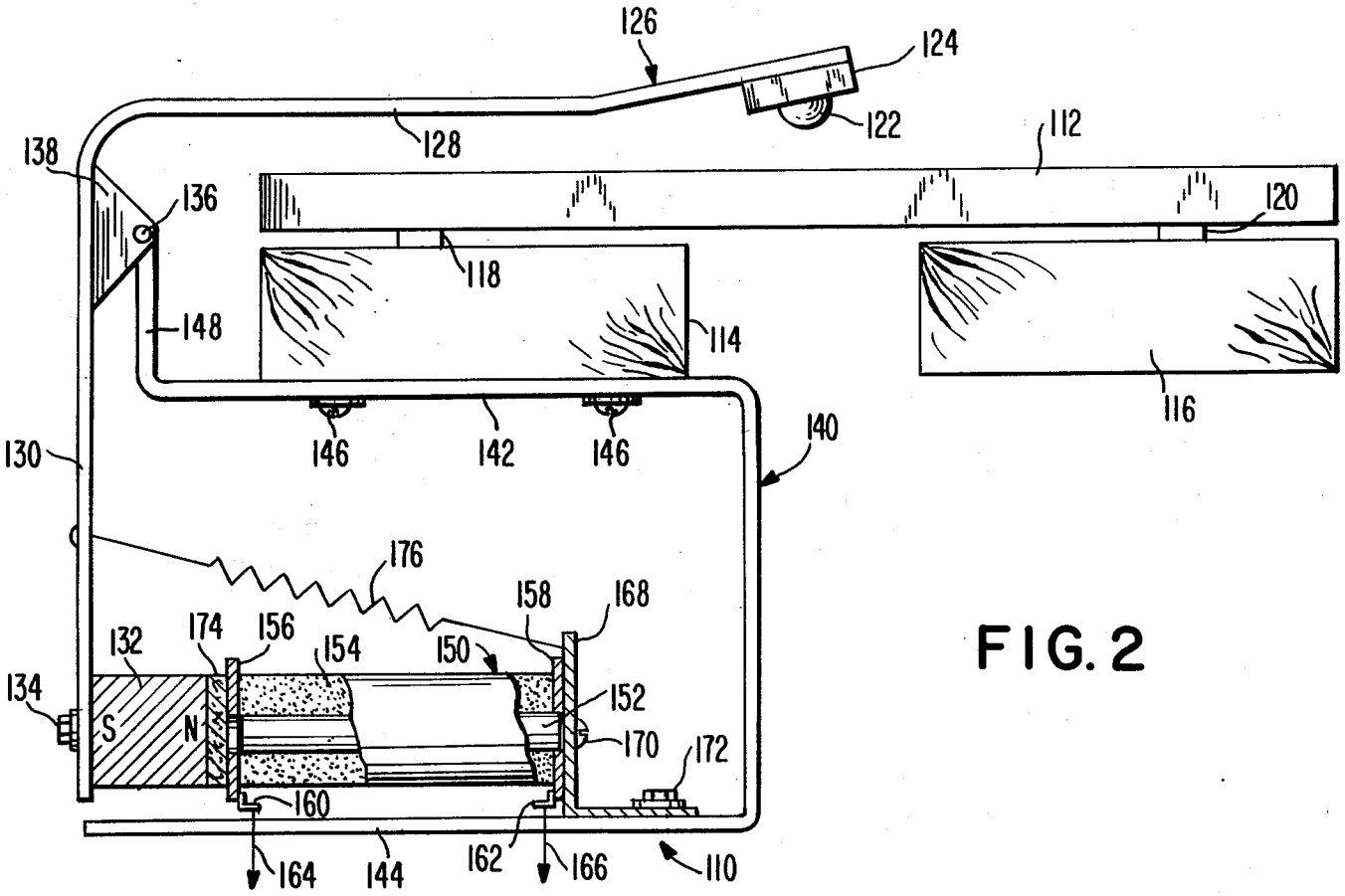
FIG. 2 is a diagrammatic side elevation view of a modified form of the striker of the present invention, shown in combination with horizontally mounted sounding surface.

To retain a highly efficient striker movement which can strike a horizontal sounding surface, the device of FIG. 2 may be used. This embodiment illustrates a striker mechanism 110 which may be employed to electrically play instruments such as marimbas, xylophones, glockenspiels, and the like. In such instruments, rectangular bars 112, which may be of wood or metal of various lengths, are supported by wooden rails 114 and 116 and resilient mountings 118 and 120, as is well-known in the art. Only one such bar 112 and one striker 110 are illustrated in the figure, but it will be understood that a similar striker mechanism is provided for each sound bar.

In accordance with the invention, the bar 112 is struck by a clapper 122 mounted by way of a ballast member 124 to an armature 126. The armature 126 is generally L-shaped, with an upper horizontal leg 128 extending over the sound bar 112 and supporting the clapper over about the midpoint thereof. A vertical leg 130 of armature 126 carries at its lower end a permanent magnet 132 which may be secured by a bolt 134. Armature 126 is pivotally mounted at about its midpoint by a pivot pin 136 passing through spaced hinge brackets 138 on armature 126 and secured to the upper end of a support bracket 140.

The support bracket 140 is a generally U-shaped flat metal bar, with an upper horizontal leg 142 and a lower horizontal leg 144. The upper leg may be mounted to the underside of rail 114 by suitable fasteners 146, and includes an upwardly extending flange portion 148 to which the hinge pin 136 is mounted. The lower leg 144 carries a solenoid 150 having an iron core 152 surrounded by a coil 154, end pieces 156 and 158, electrical terminals 160 and 162, and electrical leads 164 and 166. A bracket 168 and fasteners 170, 172 secure the solenoid to the leg 144.

Permanent magnet 132 is securely fastened to hinged armature 126 in a manner that it will be attracted to iron core 152 of solenoid 150. Such magnetic attraction will hold hinged armature 126 in the position shown in FIG. 2. Although the magnetic attraction between permanent magnet 132 and solenoid core 152 will pull them together, permanent magnet 132 can never touch the solenoid because of a resilient pad 174 attached to the end piece 156 of the solenoid.

A coil spring 176 is connected between the hinged armature 126 and the solenoid bracket 168 to hold the armature in the rest position illustrated in FIG. 2.

When a short pulse of electric current is applied to solenoid 150, through electric leads 164 and 166, having a polarity which will cause the lines of force in the core of the solenoid to oppose those of the permanent magnet 132, hinged armature 126 will rotate clockwise, as viewed in FIG. 2, causing clapper 122 to strike the musical bar 112 and then to rebound. The rebound causes the armature 126 to rotate counterclockwise, as viewed in FIG. 2. This rebound will be aided by the forces applied to the armature by spring 176 as well as the attraction of permanent 132 to iron core 152 in the absence of current flowing through solenoid 150.

When permanent magnet 132 strikes resilient pad 174, the movement of armature 126 will be stopped, since the magnetic force of the permanent magnet will, by its attraction to the iron core 152 of solenoid 150, firmly hold it in the rest position shown, thereby damping any vibrations.

It should be noted that in the cross section of the solenoid 150 shown in FIG. 2, at the end of the solenoid which attaches to the bracket 168, the iron core 152 projects to the end of the solenoid bobbin, while at the end which is near the permanent magnet 132, the iron core 152 does not project beyond the windings of the solenoid. This is done to achieve the maximum efficiency of the system both for the on (energized) and off (deenergized) modes of the solenoid.

Figure 3:
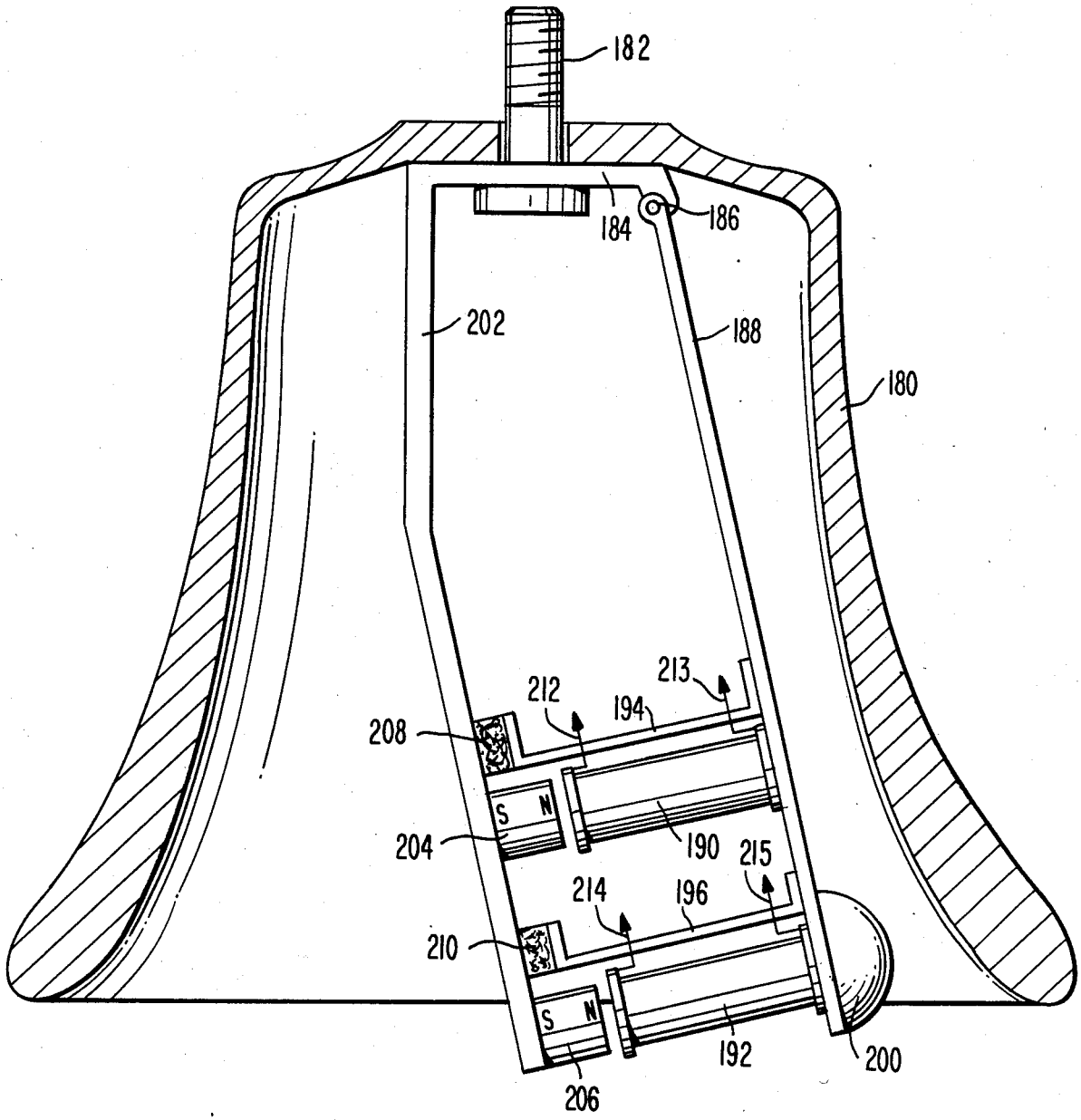
FIG. 3 is a diagrammatic side elevational view, in partial section, of a second modification of the striker of the present invention, shown as the clapper for a bell.

In another embodiment of the invention, chosen for the purpose of further illustration, there is shown in FIG. 3 in cross section a sounding surface in the form of a bell 180. The bell is supported from a beam (not shown) by a hollow supporting bolt 182 which passes through a head plate 184 within the bell. Attached to head plate 184 by a hinge 186 is a rigid armature 188. Firmly attached to the armature are two solenoids 190, 192, having iron cores (not shown) and two spacer brackets 194 and 196, as well as a clapper head 200. Also attached to headplate 3 but on the side opposite to hinge 186 is a rigid, downwardly extending support bracket 202. The support bracket carries two spaced permanent magnets 204 and 206 which are aligned with the iron cores of solenoids 190 and 192, respectively. Two spaced resilient pads 208 and 210 are also mounted on the support bracket 202, and are aligned with the ends of the spacer brackets 194 and 196, respectively. The support bracket and its attachments are secured to head plate 184 so as to remain stationary, while the armature 188 and the solenoids 190, 192, spacer brackets 194, 196, and clapper 200 carried thereby are free to move pivotally about hinge 186.

Electrical current is supplied to solenoids 190 and 192 through electrical leads 212–215, which are fed through the center of bolt 182 for connection to a controlled source of electrical current. When a short pulse of electrical current is applied to solenoids 190 and 192 having a polarity causing the solenoids to have magnetic fields which oppose those of permanent magnets 204, 206, the solenoids will be pushed away from the permanent magnets. This will cause armature 188 to rotate counterclockwise, as viewed in FIG. 3, away from its rest position to cause clapper head 200 to strike the bell 180.

Upon striking the bell, the clapper head 200 will rebound and cause armature 188 to rotate clockwise. Rotation will stop when spacer brackets 194, 196 contact resilient pads 208, 210. The clockwise rotation of armature 188 will be aided by the magnetic attraction of permanent magnets 204, 206, to the iron cores of solenoids 190, 192. This magnetic attraction dampens any bounce caused by the arrest of the motion of the armature by the interaction of resilient pads 208, 210, and brackets 194, 196. It should be noted that the construction illustrated does not permit permanent magnets 204, 206 to contact solenoids 190, 192, thereby insuring a quiet,highly damped operation.

Figure 4:
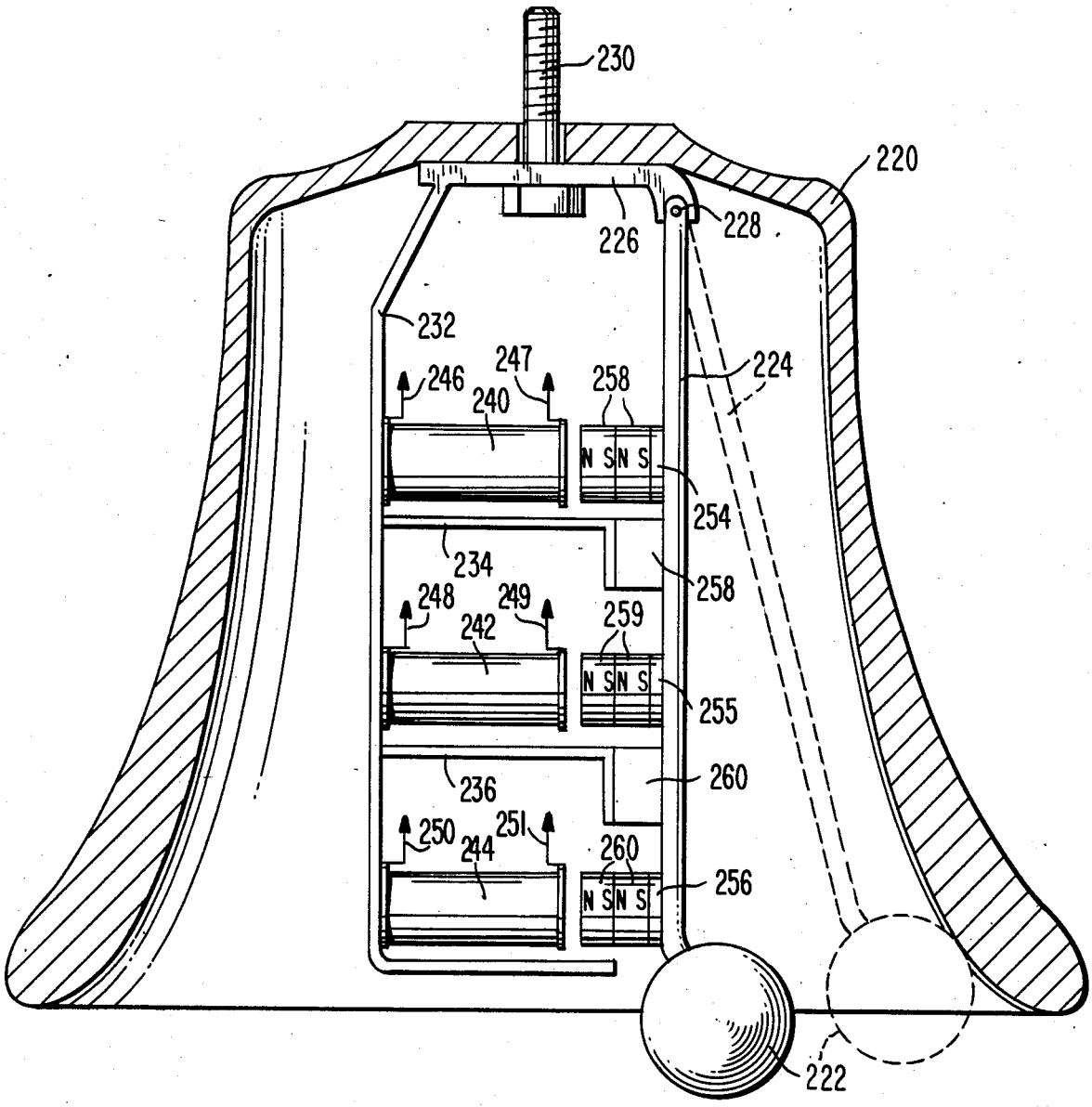
FIG. 4 is a diagrammatic side elevational view, in partial section, of a modified version of the device of FIG. 3.

In a still further embodiment of the invention, chosen for the purpose of the illustration, there is shown in FIG. 4 a bell profile 220. This essentially is a cross section taken through a typical bell which is ordinarily cast from bell metal, which is essentially an alloy of copper and tin.

The metal of such a bell will vibrate when struck by another metal object such as a clapper 222, which may be a metal sphere. In this embodiment, the clapper 222 is attached to a metal bar 224. A supporting bolt 230 is used to connect head plate 226 to the head of the bell 220 and also to attach both the head plate and the bell to a supporting beam (not shown).

Because of its manner of attachment to head plate 226, the metal bar 224, or armature, to which the clapper 222 is attached is free to move from its rest position to a striking position, shown in dotted lines, to strike the bell and produce a sound.

Firmly attached to headplate 226 is a rigid, vertical support bracket 232 to which horizontal spacer brackets 234 and 236 are attached. Also firmly attached to support bracket 232 are solenoids 240, 242, and 244, each of which has an iron core (not shown) and electrical leads 246–251, respectively. Secured to the armature 224 are mounting pads 254–256 to which are attached permanent magnet pairs 258–260, respectively. Also attached to armature 224 are resilient pads 258 and 260.

The operation of the device of FIG. 4 is similar to the devices illustrated in FIGS. 1–3. Thus, when no electrical current flows through the solenoids, the magnet pairs 258–260 are attracted to the respective iron cores of the solenoids 240, 242, and 244. The magnets are not able to contact the iron cores of the solenoids because the magnets are attached to the armature 224 whose movement is checked by the horizontal spacer brackets 234 and 236 when the resilient pads 258 and 260 contact them. However, they are close enough together that even when no current flows through the solenoids, the armature 224 and the clapper 222 are held firmly in the rest position shown in FIG. 4.

Each time a pulse of direct electrical current is applied to solenoids 240, 242, and 244 through electrical leads 246–251 from a source of current (not shown), and with a polarity so that a magnetic field will be induced in each solenoid which will oppose that of the respective permanent magnet pairs 254–256, the magnet pairs will be repelled. This action will cause the clapper 222 attached to the armature to strike the bell 220. It should be noted that,since the length of travel of each of the permanent magnets will be different, they will exert different forces on clapper 222 once it begins to move.

For optimum performance, the pulse of direct electrical current will be of such duration that it will terminate just as the clapper reaches the bell. This can be achieved in many well-known ways, through the use of known pulse generating circuitry and suitable timers or switches. For example, the pulse termination could be accomplished by using the clapper and the bell as two elements of an electric switch, which would disable the pulse generator. As in previous embodiments, once the clapper strikes the bell, it will rebound and be accelerated toward the rest position. Since, at this time, the magnetic field of the solenoids will have collapsed because of termination of the drive pulse, the permanent magnets 254–256 will again be drawn to the iron cores of the solenoids and will move the armature 224 to its rest position, without vibration or bounce. This highly damped clapper mechanism will then be immediately ready for reactuation by another pulse.

Although in the illustration of FIG. 4 three solenoid and permanent magnet sets are shown for driving the clapper, this is done in order to obtain the required power for heavy striker mechanisms. One solenoid-magnet set may suffice for a small bell, while additional solenoids may be needed to obtain the desired striking power for large bells.

The sound power delivered by the clapper, in any of the above-described embodiments will depend upon the weight of the clapper, the amplitude and duration of the applied electrical pulse, the distance to be traversed by the clapper, and like factors. The sound volume produced by any one of the clapper devices similarly can be modified by an operator varying the amplitude and/or duration of the pulse of electrical current. In this way, very precise control of the sound can be obtained Further, because of the high degree of damping of the striker mechanism provided by the present invention, a high repetition rate can be attained without loss of volume, for the absence of bounce insures that a subsequent pulse will deliver the same striking power as each preceding pulse. The use of a controllable pulse generator for driving the solenoids permits selection of the pulse duration and amplitude independently of the length of time the actuating key is depressed. Thus, operation of key 88 would result in the production of a single drive pulse by generator 86, which pulse will have a predetermined amplitude and duration to produce a single motion of the clapper against the sounding surface, even if the key is not released. To produce the next motion of the striker, the operator need only release the key and depress it again,thereby obtaining a sound that is substantially identical in volume to the preceding sound, the only restriction being that the time between strikes be sufficiently long to allow the clapper to return to its rest position.

Although the present invention has been described in terms of a preferred embodiment thereof, it will be apparent that numerous variations and modifications can be made without departing from the true spirit and scope thereof, as set forth in the following claims.

What is claimed is:

1. A highly damped actuator for striking a sound-producing surface in a percussion musical instrument, comprising:

armature means;

clapper means mounted on said armature;

means for mounting said armature for motion of said clapper between a rest position spaced from a sound-producing surface and an impact position at said sound-producing surface;

a permanent magnet-solenoid set for holding said clapper at said rest position; and means for applying an electrical current pulse to said solenoid, said pulse being of sufficient amplitude to produce a repelling magnetic field between the permanent magnet and the solenoid of said set which drives said armature from its rest position toward said impact position and which causes said clapper to strike said sound-producing surface, and for terminating said pulse to collapse said magnetic field between the permanent magnet and the solenoid of said set to facilitate return of said armature to its rest position for retention by said permanent magnet.

2. The actuator of claim 1, wherein said permanent magnet-solenoid set includes an electrical solenoid including a core fixedly mounted adjacent to said rest position and a permanent magnet mounted on said armature for motion therewith, the magnetic field of said permanent magnet normally attracting said armature toward said solenoid core tc hold said armature in said rest position.

3. The actuator of claim 2, wherein said means for mounting said armature includes a flexible strap for suspending said armature for substantially horizontal motion of said clapper.

4. The actuator of claim 2, wherein said means for mounting said armature includes a pivot means for suspending said armature for substantially horizontal motion of said clapper.

5. The actuator of claim 2, wherein said means for mounting said armature includes hinge means for suspending said armature for substantially horizontal motion between said permanent magnet and said solenoid and for substantially vertical motion of said clapper along a predetermined path.

6. The actuator of claim 2, wherein said means for mounting said armature includes fixed pivot means, whereby application of an electrical current to said solenoid causes said armature to rotate about a pivot point to carry said clapper along a predetermined path toward said sound-producing surface.

7. The actuator of claim 1, wherein said means for mounting said armature includes a fixed bracket, said fixed bracket further including means for securing, in a fixed location adjacent said rest position, either said permanent magnet or said solenoid of said permanent magnet-solenoid set, the other of said permanent magnet or said solenoid being mounted on said armature.

8. The actuator of claim 7, wherein said permanent magnet is mounted on said fixed bracket.

9. The actuator of claim 7, wherein said solenoid is mounted on said fixed bracket.

10. The actuator of claim 1, wherein said permanent magnet-solenoid set includes an electrical solenoid with a core mounted on said armature for motion therewith along a predetermined path, and a permanent magnet fixedly mounted adjacent said rest position in alignment with said solenoid predetermined path, the magnetic field of said permanent magnet normally attracting said armature toward said permanent magnet to hold said armature in said rest position.

11. The actuator of claim 1, wherein said means for applying electrical current includes an electrical pulse generator connected to said solenoid, and switch means for initiating a pulse to produce said repelling magnetic field in said solenoid.

12. The actuator of claim 11, wherein said pulse applied to said solenoid and said repelling magnetic field terminates at or before the time said armature reaches said impact position, whereby rebound of said armature caused by said clapper striking said sound-producing surface returns said armature toward said rest position without resistance from said repelling magnetic field.

13. The actuator of claim 12, wherein said pulse is of an amplitude and duration sufficient to move said clapper to strike said sound-producing surface with a force to produce a predetermined volume of sound.

14. The actuator of claim 1, further including sound absorbing means interposed between the solenoid and the permanent magnet of said set.

15. The actuator of claim 1, further including stop means for damping the motion of said clapper from said impact position toward said rest position.

16. The actuator of claim 1, wherein said armature is an elongated flat plate adapted to receive said clapper means and one of said permanent magnet-solenoid set.

17. An actuator for striking a sound-producing surface in a percussion instrument, comprising:

a frame for said musical instrument;

support bracket means fixedly secured to said frame and including a support arm;

solenoid means affixed to said support arm and defining a rest position, said solenoid including a fixed core of magnetic material and a coil surrounding at least a part of said core;

an elongated armature;

means mounting said armature for motion along a predetermined path between said rest position and a sound-producing surface;

clapper means mounted on said armature for striking said sound-producing surface upon motion of said armature toward said surface;

permanent magnet means mounted on said armature, said permanent magnet means attracting said armature toward said solenoid core to normally hold said armature in said rest position; and means for applying electric current to said solenoid coil to produce a magnetic field in said core in a direction to repel said permanent magnet means on said armature, thereby to propel said armature along said predetermined path to cause said clapper to strike said sound-producing surface, and for terminating said electric current at about the time said clapper means reaches said sound-producing surface, said clapper rebounding from said sound-producing surface to return to said rest position, in the absence of said magnetic field, the motion of said armature being damped by the attraction of said permanent magnet to said solenoid core.

* * * * *